US005476577A

United States Patent [19]

May et al.

[11] Patent Number: 5,476,577

[45] Date of Patent: Dec. 19, 1995

[54] DEVICE FOR THE ELECTROLYTIC DEPOSITION OF METAL ON METAL STRIPS

[76] Inventors: Hans J. May, Ulmenweg 17, D-58638 Iserlohn; Roland Schnettler, Schwerter Str. 138, D-58099 Hagen, both of Germany

[21] Appl. No.: 295,773

[22] PCT Filed: Nov. 21, 1992

[86] PCT No.: PCT/DE92/00983

§ 371 Date: Aug. 31, 1994

§ 102(e) Date: Aug. 31, 1994

[87] PCT Pub. No.: WO93/11282

PCT Pub. Date: Jun. 10, 1993

[30] Foreign Application Priority Data

Nov. 28, 1991 [DE] Germany ..... 41 39 066.0

[51] Int. Cl.[6] ..... C25D 17/00

[52] U.S. Cl. ..... 204/206; 204/224 R; 204/DIG. 7

[58] Field of Search ..... 204/DIG. 7, 206, 204/224 R, 224 M

[56] References Cited

U.S. PATENT DOCUMENTS

| | | | |
|---|---|---|---|
| 2,974,097 | 3/1961 | Ramirez et al. | 204/224 R X |
| 3,399,130 | 8/1968 | Lovekin | 204/206 |
| 3,537,971 | 11/1970 | Green | 204/206 X |
| 4,784,740 | 11/1988 | Murakami et al. | 204/206 |

OTHER PUBLICATIONS

Patent Abstracts of Japan, vol. 10, No. 120, Dec. 5, 1985.

*Primary Examiner*—Donald R. Valentine
*Attorney, Agent, or Firm*—Collard & Roe

[57] ABSTRACT

In a device for the electrolytic deposition of metal on the metal strips (1) forming the cathode, which are taken through a gap in an electrolyte (3) between two flat or rod-like parallel anodes (2), the proposal is for edge masks (4) to screen off the edge regions of the metal strip (1). The shanks (41) of each edge mask (4) are prestressed by springs against the anodes (2) and their relatively wide shanks may be directed transversely to the direction of the strip in order to take transitions between different strip widths into account.

4 Claims, 1 Drawing Sheet

DEVICE FOR THE ELECTROLYTIC DEPOSITION OF METAL ON METAL STRIPS

Figure 1:
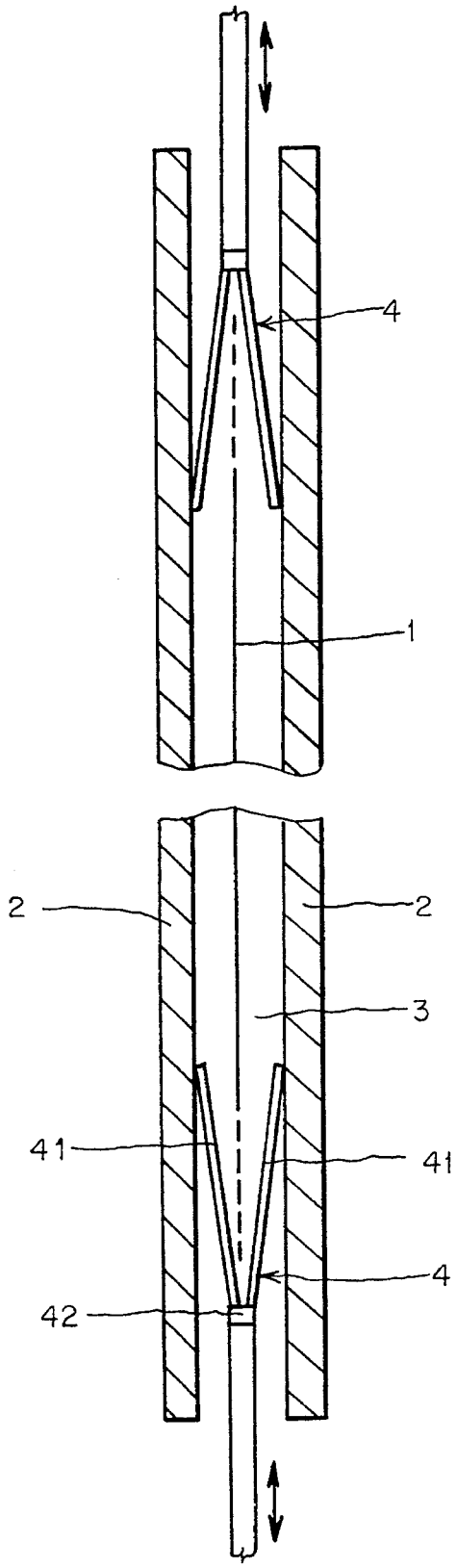

The invention relates to a device for the electrolytic deposition of metal on the metal strips forming the cathode, preferably steel strips, in accordance with the introductory part of claim 1.

A device of said type is known, in which for the prevention of irregular and excessive deposition of the metal on a metal strip to be galvanized, provision is made in the gap between each two parallel, plate-like anodes for edge masks having a U-shaped cross section, which masks, with their two shanks extending parallel with each other, such shanks being suitably set up transversely to the direction of the strip, enclose the edge zones of the metal strip to be coated, and thus screen off said zones against the electrical field, so that the deposition occurring in the respective edge zones of the metal strip is not stronger than the other deposition on the strip. Said edge masks are made of an insulating material, preferably of plastic material. In view of the relatively large anode plates, said plastic masks with a U-shaped cross section have a length of up to two meters and are, therefore, relatively unstable, corresponding to the small gap between the strip and the anodes, so that only relatively small shank widths can be formed. It is necessary in practical life to coat in strip refining plants strip charges with different widths of the strips. After the strips of a certain widths—which, as a rule, run off coils—have been treated, it is, therefore customary to weld the next strip to the end. Such next strip may have a different width. For the purpose of adapting the screening of the edge zone to the next-following strip to be coated, the edge masks can be set up transversely to the direction of the strip. When the next-following strip is inserted between the two shanks of the edge masks, the zone of transition of the strip with the break in width causes problems in this connection. Since the shanks of the edge masks have only a relatively short length, it happens that the next-following strip will not "thread" itself between the two shanks but is guided between the outer side of a shank and the adjacent anode, which can destroy the edge masks and damage the anodes. However, the width of the shanks of the known edge masks cannot be enlarged, as this will make the edge mask too unstable. In addition, the electrolyte flows through the gap between the anodes still at a relatively high rate, whereby a pressure difference is caused between the inside and the outside of each mask shank due to differences in flow pressure, such pressure difference subjecting the shank to an inwardly directed pressure. Therefore, shanks with low stiffness, if excessively long, are forced inwardly and thereby narrow the clear spacing between the shanks. With the known masks with the relatively short shanks, there is the additional risk that the sheets to be coated knock in an undesirable way against the inside of the shanks or against the bridge of the masks due to their tolerances in guidance and because of uneven spots, and thus may even damage or destroy the masks. Therefore, only masks with a small outside dimension can be used in the narrow gap, which amounts to about between 20 mm to 50 mm. It is not possible to visually monitor the masks in the device from the outside.

The object of the invention is to enhance on a device of the type specified above the edge masks in order to particularly assure the screening in a deposition process after changing from one strip to another of a different width.

The object of the invention is solved on a device of the type specified above, such device being characterized in that the shanks of each edge mask rest against the anodes with elastic prestress.

If edge masks according to the invention are correspondingly arranged between the anodes, it is possible due to the predetermined elastic prestress to realize substantially greater widths of the shanks of the edge mask made of suitably insulating material because on the one hand, by having the shanks rest against the anodes under elastic prestress, a more stable position of the edge masks within the gap is obtained and, therefore, an additional support of such masks. On the other hand, the pressure difference caused by the flow of the electrolyte on the shanks is counteracted by the prestress in a compensating manner. The springy butting of the shanks of the edge mask provides for a total screening of the edge zone of the metal strip against any possible electrical field from the outside of the anodes outside the zone of the strip width.

Therefore, with devices having the edge masks according to the invention, it is possible to realize relatively large shank widths of up to 200 mm, so that the usable depth of the edge mask is much greater than with conventional edge masks. Therefore, with such a relatively deep edge mask it is possible also to bridge without problems breaks in strip width without running the risk that the next-following strip of a different width will "thread" itself "out" of such an edge mask.

Preferably, corresponding edge masks should have a V-shaped cross section, whereby the apex of the "V" may also form a bridge connecting the shanks.

The associated drawing shows in cross section a basic view of the zone of the two anodes kept spaced apart, whereby the metal strip to be coated is passed in an electrolyte through about the center of the gap spacing said anodes apart.

The two anodes are denoted by reference numeral 2. The metal strip to be coated, which has a smaller width, is denoted by the reference numeral 1. The electrolyte is indicated by reference numeral 3. The edge masks made of an insulating material, which are denoted by numeral 4, are arranged in the gap transversely to the direction of the metal strip 1. Said edge masks have a V-shaped cross section. Their two shanks 41 rest under elastic prestress against the insides of the anodes 2 and enclose the edge zone of the metal strip 1 in order to screen it off against a maintained electrical field. The two shanks 41 are connected with each other by a bridge 42. The way in which said edge mask 4 can be set up for adapting it to different strip widths is indicated by the two arrows.

We claim:

1. Device for the electrolytic deposition of metal on a cathode formed by a metal strip, comprising two plate-like or rod-like anodes arranged parallel to each other with a gap therebetween;

said metal strip being guided through said gap in an electrolyte adopted to be between said two anodes;

two edge masks each having two shanks for enclosing in a screening way the edge zone of the metal strip and set up in said gap transversely to the direction of the strip; and said shanks of each edge mask rest against the anodes with elastic prestress.

2. Device according to claim 1, wherein the edge masks have a V-shaped cross section.

3. Device according to claim 2, wherein the apex of the "V" forms a bridge connecting the shanks.

4. Device according to claim 1, wherein said edge masks are adjustable transversely to the strip direction.

* * * * *